US006896531B2

(12) United States Patent
Bakker et al.

(10) Patent No.: US 6,896,531 B2
(45) Date of Patent: May 24, 2005

(54) ELECTRICAL CONNECTOR ASSEMBLY

(75) Inventors: John H. Bakker, Cortland, OH (US); Joseph A. Wilson, Cortland, OH (US); John M. Chupak, West Middlesex, PA (US); Joseph A. Svette, Jr., Newton Falls, OH (US)

(73) Assignee: Delphi Technologies, Inc., Troy, MI (US)

( * ) Notice: Subject to any disclaimer, the term of this patent is extended or adjusted under 35 U.S.C. 154(b) by 303 days.

(21) Appl. No.: 10/159,174

(22) Filed: May 31, 2002

(65) Prior Publication Data

US 2003/0003786 A1 Jan. 2, 2003

Related U.S. Application Data

(63) Continuation-in-part of application No. 09/795,692, filed on Feb. 27, 2001, now Pat. No. 6,422,881.

(51) Int. Cl.[7] ..... H01R 13/44
(52) U.S. Cl. ..... 439/140; 439/157
(58) Field of Search ..... 439/140–141, 439/752, 598, 157

(56) References Cited

U.S. PATENT DOCUMENTS

| | | | | |
|---|---|---|---|---|
| 5,501,606 A | | 3/1996 | Oda et al. | |
| 5,810,612 A | * | 9/1998 | Flask et al. | 439/157 |
| 5,879,174 A | | 3/1999 | Kountz et al. | |
| 6,086,385 A | | 7/2000 | Wang et al. | 439/67 |
| 6,142,813 A | | 11/2000 | Cummings et al. | 439/374 |
| 6,162,085 A | | 12/2000 | Chugh et al. | 439/467 |
| 6,171,146 B1 | | 1/2001 | Fink et al. | 439/595 |
| 6,179,658 B1 | | 1/2001 | Gunay et al. | 439/587 |
| 6,203,364 B1 | | 3/2001 | Chupak et al. | 439/527 |
| 6,208,233 B1 | | 3/2001 | Stein, Sr. et al. | 338/195 |
| 6,247,951 B1 | | 6/2001 | Di Liello et al. | 439/329 |
| 6,247,965 B1 | | 6/2001 | Cummings et al. | 439/587 |
| 6,305,957 B1 | | 10/2001 | Fink et al. | 439/157 |
| 6,338,651 B1 | | 1/2002 | Svette, Jr. et al. | 439/559 |
| 6,345,706 B1 | | 2/2002 | Oliver et al. | 188/282.2 |
| 6,406,307 B2 | | 6/2002 | Bungo et al. | 439/130 |
| 6,443,137 B1 | | 9/2002 | Kraft et al. | 123/634 |
| 6,454,060 B1 | | 9/2002 | Lisenker et al. | 521/41 |
| 6,494,751 B1 | | 12/2002 | Morello et al. | 439/752 |
| 6,508,666 B1 | | 1/2003 | Francis | 439/548 |
| 6,533,588 B1 | | 3/2003 | Woith et al. | 439/67 |
| 6,533,611 B2 | | 3/2003 | Morello et al. | 439/595 |
| 6,535,396 B1 | | 3/2003 | Degenkolb et al. | 361/775 |
| 6,556,118 B1 | | 4/2003 | Skinner | 336/182 |
| 6,565,372 B2 | | 5/2003 | Bakker et al. | 439/157 |
| 6,578,444 B1 | | 6/2003 | Wendelin | 74/495 |

* cited by examiner

*Primary Examiner*—Javaid H. Nasri
(74) *Attorney, Agent, or Firm*—David P. Wood

(57) ABSTRACT

An electrical connector assembly has a male connector which houses and locks to a series of male bladed terminals and a female connector housing and locking to a series of female terminals. A blade of each male terminal extends into a chamber defined by a shroud of the male connector. Prior to mating of the electrical connector assembly, a self-aligning blade stabilizer is snap fitted into a pre-staged position with the male connector via a two-stage fastening feature so that the distal ends of the blades are disposed within respective apertures of the stabilizer and aligned to their respective female terminals. With the blade stabilizer held in a pre-staged position, the distal ends of the blades are protected from being inadvertently knocked and bent which would cause misalignment. Furthermore, the stabilizer prevents entry of debris into the chamber of the male connector which would hinder or prevent full mating of the electrical connector. During mating of the electrical connector assembly, the stabilizer is pushed out of the pre-staged position and into a staged position as the blades travel through the apertures and into the female terminals of the female connector.

30 Claims, 9 Drawing Sheets

ELECTRICAL CONNECTOR ASSEMBLY

RELATED PATENT APPLICATION

This is a continuation-in-part application of U.S. patent application Ser. No. 09/795,692, filed Feb. 27, 2001 now U.S. Pat. No. 6,422,881.

TECHNICAL FIELD

The present invention relates to an electrical connector assembly, and more particularly to an electrical connector assembly having a self-aligning, pre-staging, terminal blade stabilizer.

BACKGROUND OF THE INVENTION

A multi-bladed electrical connector has a male connector portion which firmly supports a series of male terminals that are locked within respective terminal cavities of the male connector portion. A female connector portion of the electrical connector mates typically via a snap locking feature to the male connector portion. When mating, the pins are received by respective pin receptacles of the female connector portion to form the electrical connections.

A blade or pin of each terminal projects forward from each terminal cavity and into a common blind bore or chamber defined by a forward projecting circumferential encasement or shroud of the male connector portion. The female connector portion of the electrical connector houses the series of pin receptacles which communicate through a leading end of the female connector portion. For a reliable electrical connection, each pin receptacle must align with its respective pin of the terminal of the male connector portion. When the electrical connector is mated, the leading end portion of the female connector portion fits into the chamber of the male connector portion and is thus guided by the circumferential encasement.

Unfortunately, during the manufacturing phase and/or handling of a wire harness, which is engaged to the male connector portion of the electrical connector, the exposed protruding pins of the terminals can potentially be knocked or bent, or debris may enter the chamber of the male connector portion which results in the inability of the terminals to connected electronically within the pin receptacles of the female connector portions. Moreover, the manufacturing dimensional variances between the terminals and the male connector portion housing cause the terminals to pivot slightly within the housing and the distal ends of the pins to become misaligned with the receptacles.

SUMMARY OF THE INVENTION

An electrical connector assembly has a male connector which houses and locks to a series of male bladed terminals and a female connector housing and locking to a series of female terminals. A blade of each male terminal extends into a chamber defined by a shroud of the male connector. Prior to mating of the electrical connector assembly, a self-aligning blade stabilizer is snap fitted into a pre-staged position with the male connector via a two-stage fastening feature so that the distal ends of the blades are disposed within respective apertures of the stabilizer and aligned to their respective female terminals. With the blade stabilizer held in a pre-staged position, the distal ends of the blades are protected from being inadvertently knocked and bent which would cause misalignment. Furthermore, the stabilizer prevents entry of debris into the chamber of the male connector which would hinder or prevent full mating of the electrical connector. During mating of the electrical connector assembly, the stabilizer is pushed out of the pre-staged position and into a staged position as the blades travel through the apertures and into the female terminals of the female connector.

The two-stage fastening feature is constructed and arranged between the stabilizer and the housing of the electrical connector. Preferably, the two stage fastening feature entails a protuberance which projects radially or laterally outward from a shroud of the stabilizer and a forward and rearward locking nub which projects laterally inward from the circumferential encasement of the male connector portion. The protuberance is disposed axially between the forward and rearward locking nubs when the stabilizer is in the pre-staged position and is snap fitted over the rearward locking nub when the stabilizer moves from the pre-staged position to the staged position, simultaneously, as the electrical connector is being mated.

An advantage of the present invention is the prevention of accidental misalignment or bending of the protruding blades of the terminals of the male connector portion. Another advantage of the present invention is the elimination of foreign article or debris collection within the chamber of the male connector portion which could prevent full mating of the electrical connector. Yet another advantage of the invention is the incorporation of a blade stabilizer having a pre-staged position without having to re-design the male or female connector of the electrical connector assembly.

BRIEF DESCRIPTION OF THE DRAWINGS

The presently preferred embodiments of the invention are disclosed in the following description and in the accompanied drawings, wherein.

DETAILED DESCRIPTION OF THE PREFERRED EMBODIMENTS

Figure 1:
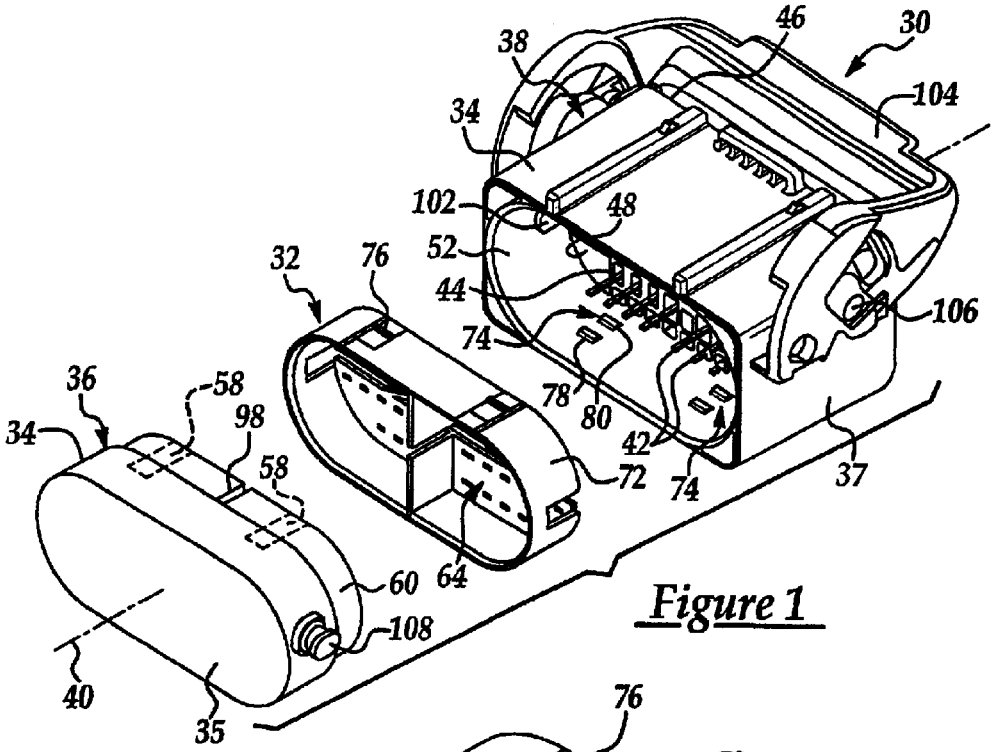
FIG. 1 is an exploded perspective view of the electrical connector assembly of the present invention.
Figure 2:
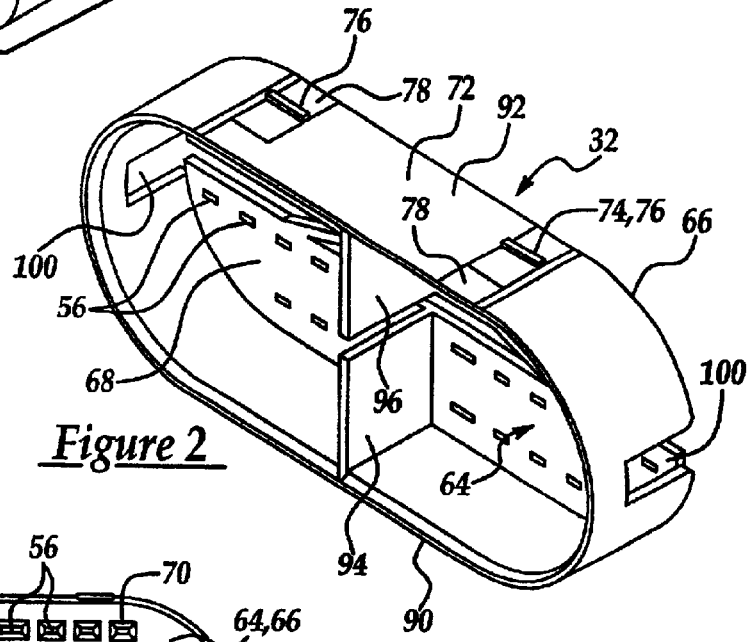
FIG. 2 is a perspective view of a blade stabilizer of the electrical connector assembly.
Figure 3:
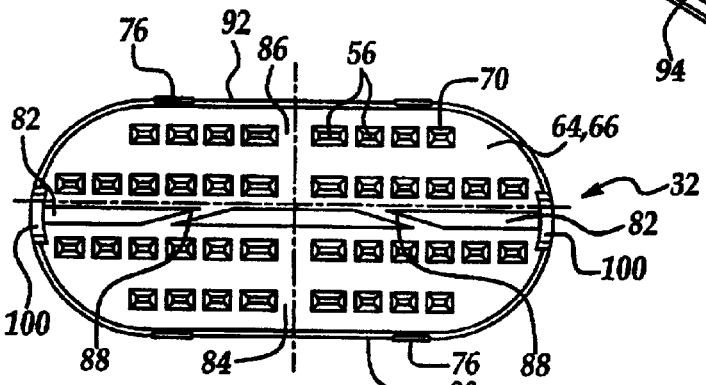
FIG. 3 is a rear plan view of the blade stabilizer.
Figure 4:
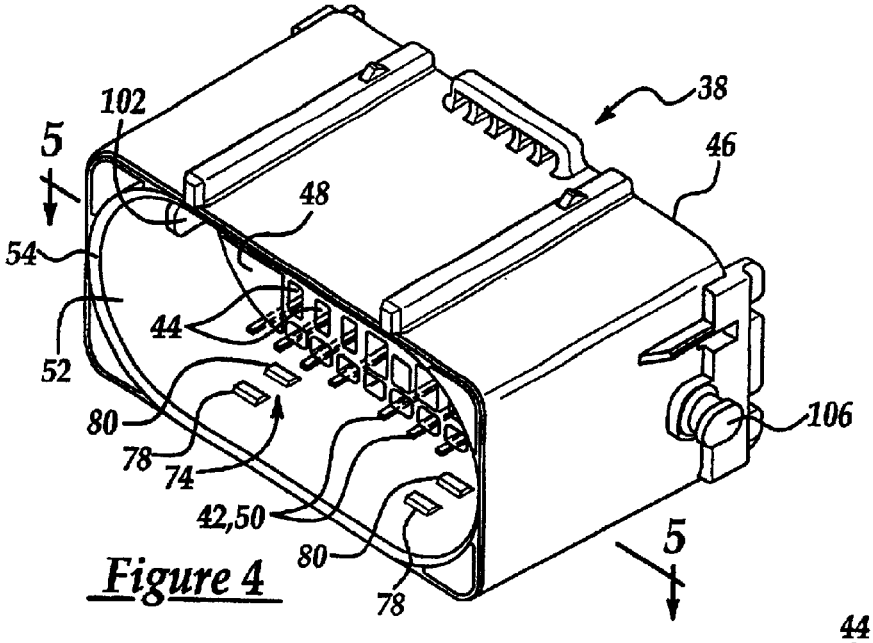
FIG. 4 is a perspective view of a male connector of the electrical connector assembly.

Referring now to the drawings, FIG. 1-6, illustrate a multi-pin electrical connector assembly 30 having a self-aligning, pre-staging, pin or blade stabilizer 32 which ensures reliable electrical connection of the assembly. The plastic blade stabilizer 32 is disposed within a housing 34 of the electrical connector assembly 30 which has a first part being the plastic body 35 of a female connector 36 and a second separate part being the plastic body 37 of a male connector 38. The stabilizer 32 is disposed axially between the female and male connectors 36, 38 along a mating axis 40.

Figure 5:
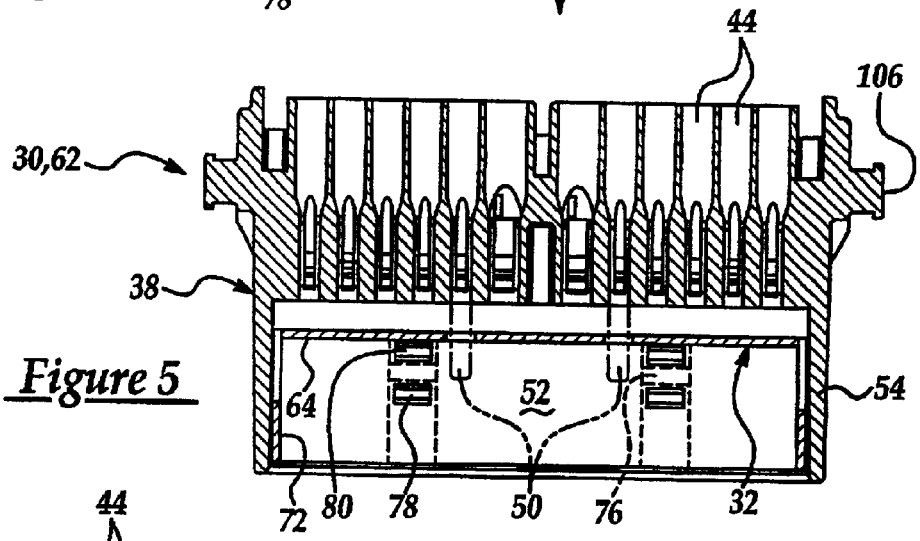
FIG. 5 is a cross section view of the male connector of the electrical connector assembly taken along line 5—5 of FIG. 4 viewing in the direction of the arrows.

The body 37 of the male connector 38 rigidly engages and locks to a series of terminals 42 disposed within respective cavities 44 of the male connector body which that communicates axially between a rearward face 46 and a forward face 48 of the male connector body 37. Each terminal 42 has a pin or blade 50 which projects forward from the forward face 48 into a blind bore or chamber 52 defined circumferentially by a shroud or circumferential encasement 54 of the male connector body 37. When the electrical connector 30 is mated, each pin 50 of the terminals 42 extends through a respective aperture 56 of the blade stabilizer 32 and into respective female terminals or pin receptacles 58 disposed within a leading end 60 of the female connector body 35. Prior to mating of the electrical connector 30, the blade stabilizer 32 is inserted into the chamber 52 of the male connector 38 until it engages into a pre-staged position 62, as best shown in FIG. 5.

When in the pre-staged position 62, distal ends of the pins 50 of the terminals 42 are disposed within or slightly extend forward beyond the apertures 56 of the blade stabilizer 32. The blade stabilizer 32 eliminates or reduces exposure of the pins 50 (i.e. from 6.5 mm to 1.5 mm) which could otherwise lead to bending or mis-alignment of the pins with respect to the female connector receptacles 58. Any pivoting action of the terminal 42 within the cavity 44 of the male connector 38 which could lead to misalignment of the pins 50 with respect to the female connector receptacles 58 is also prevented when the blade stabilizer 32 is in the pre-staged position 62.

The blade stabilizer 32 has a plate 64 which carries a leading surface 66 that faces the male connector 38 and a trailing surface 68 that faces the female connector 36. The apertures 56 communicate between the leading and trailing surfaces 66, 68 of the plate 64. Each aperture 56 has a beveled peripheral edge 70 carried by the leading surface 66 to help guide the distal ends of the pins 50 into the respective aperture 56. A shroud 72 of the blade stabilizer 32 projects axially forward from the periphery of the trailing surface 68 of the plate 64. The blade stabilizer 32, when viewed separately from the male connector 38, is similar or identical to the blade stabilizer described in U.S. Pat. No. 5,879,174, issued Mar. 9, 1999, which is incorporated herein by reference. However, when utilized with the male connector 38 of the present invention, the blade stabilizer 32 interacts with an integral two-stage fastening feature or indent-detent interface 74 not previously taught or described.

The two-stage fastening feature 74 includes four protuberances 76 which are spaced circumferentially about the shroud 72 of the stabilizer 32. Each protuberance 76 is elongated circumferentially with respect to the shroud 72 and projects laterally outward from a slight depression area 78 carried by the shroud 72 which extends axially. Each protuberance 76 interacts with respective forward and rearward locking nubs 78, 80 which project laterally or radially inward from the circumferential encasement 54 of the male connector 38. During assembly, when the stabilizer is placed in the pre-staged position 62, the protuberance 76 snap fits axially over and settles just rearward of the forward locking nub 78. Therefore, the shroud 72, must flex substantially radially inward and then snap radially outward to place the protuberance 76 between the forward and rearward locking nubs 78, 80 thus placing the stabilizer 32 in the pre-staged position 62. To assist in this snap fit or flexing and adjust for manufacturing variances of the male connector 38, a slot 82 of the self-aligning stabilizer 32 extends through the plate 64 and enables such flexing. The slot 82 divides the plate 64 into a first and a second segment 84,86 which are interconnected by flexing or web members 88 which bridge the slot 82.

The stabilizer 32 is elongated laterally with respect to the electrical connector assembly 30 thus matching the profile of the circumferential encasement 54 of the male connector 38 to prevent rotation of the stabilizer 32 which would misalign the blades 50. The slot 82 extends longitudinally laterally with respect to the stabilizer 32. The shroud 72 therefore has two elongated sides 90, 92 wherein two protuberances 76 are located on each elongated side. The elongated sides 90, 92 flex radially inward toward one another as the protuberances 76 pass over the forward locking nubs 78 of the male connector 38.

Figure 6:
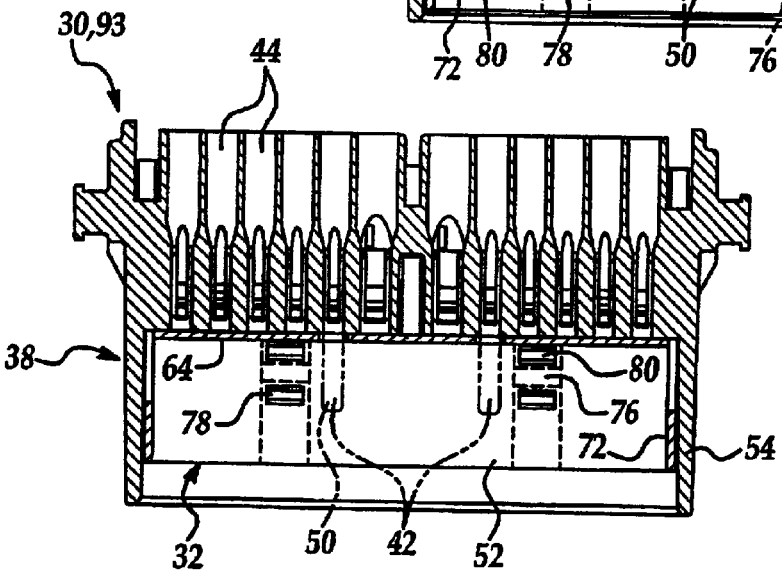
FIG. 6 is a cross section view of the male connector and stabilizer, similar in perspective to FIG. 5, but shown in a fully staged position with the female connector removed to show internal detail.
Figure 7:
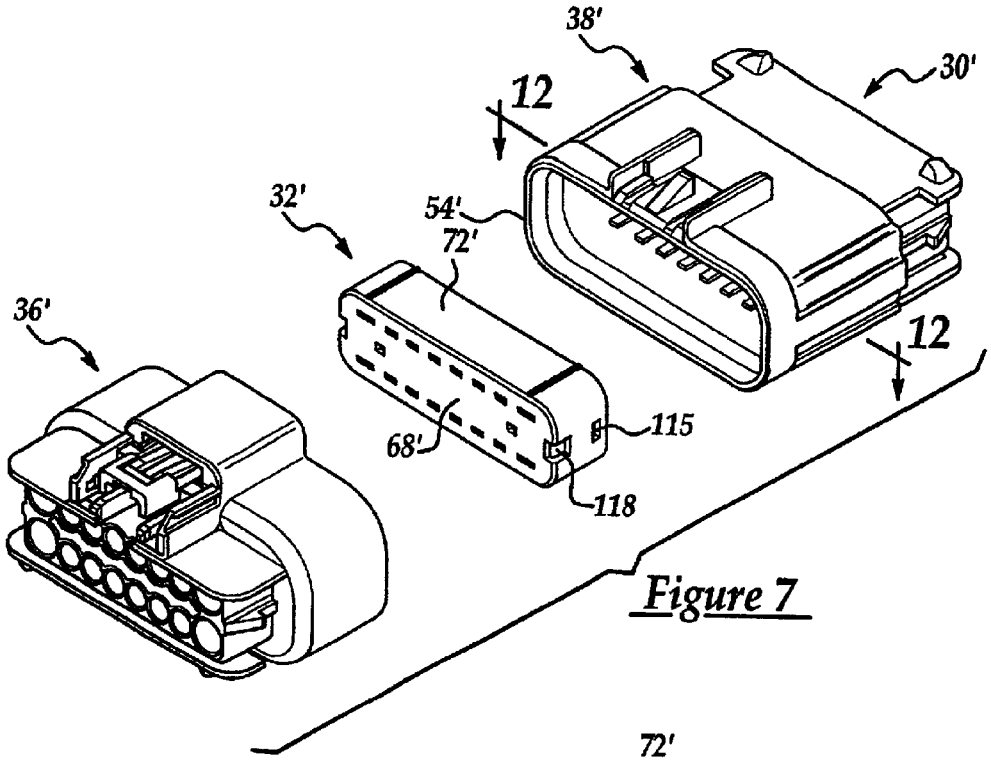
FIG. 7 is an exploded perspective view of a second embodiment of an electrical connector assembly of the present invention.
Figure 8:
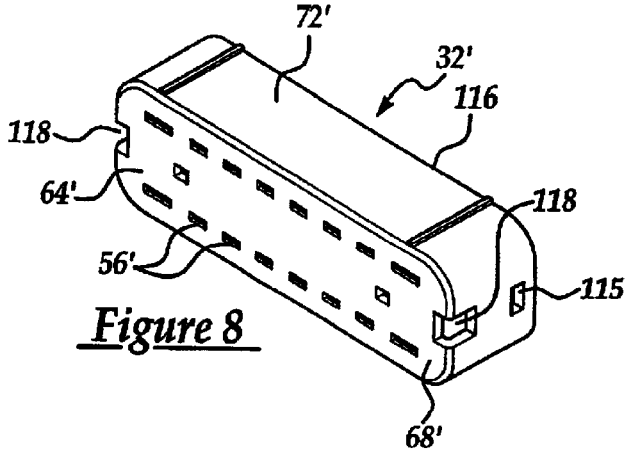
FIG. 8 is a perspective view of a blade stabilizer of the second embodiment.
Figure 9:
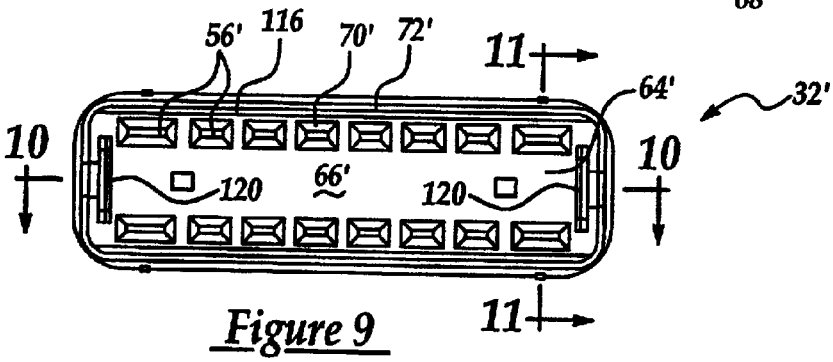
FIG. 9 is a rear plan view of the blade stabilizer of the second embodiment.

With the stabilizer 32 engaged to the male connector 38 in a pre-staged position 62, mating of the electrical connector assembly 30 may be done at leisure without worry of debris entry into the blade environment 52 of the male connector 38 or bending and misalignment of the terminals 42 which could prevent or degrade electrical continuity of the connector assembly 30. During mating of the assembly 30, the shroud 72 of the stabilizer 32 surrounds the leading end 60 of the female connector 36. The leading end 60 engages the trailing surface 68 of the stabilizer 32 and pushes the stabilizer 32 rearward within the chamber 52, out of the pre-staged position 62 and into a staged position 93 when the electrical connector assembly 30 is mated, as best shown in FIG. 6. When the stabilizer 32 moves from the pre-staged position 62 and into the staged position 93, the protuberances 76 of the indent-detent interface 74 snap fit rearward of the rearward locking nubs 80.

A first stiffener 94 is engaged unitarily to the first segment 84 and the perpendicular first side 90 of the shroud 32 and a second stiffener 96 is engaged to the second segment 86 of the plate 64 and the perpendicular second side 92 of the shroud 32. These stiffeners 94, 96 assist in keeping the stabilizer aligned within the male connector 38, prevent the stabilizer 32 from twisting or deforming, and keep the plate 64 perpendicular to the mating axis 40. The stiffeners 94, 96 are received within a respective groove 98 carried by the leading end 60 of the female connector 36.

At each end of the elongated blade stabilizer 32, an indexing window 100 is carried by the shroud 72 and is indexed into an indexing tab 102 projecting laterally inward from the circumferential encasement 54 of the male connector body 37. The tab 102 is indexed into the window 100 when the stabilizer 32 is in the staged position 93 and the electrical connector assembly 30 is mated. Referring to FIG. 1, the electrical connector assembly 30 has a cam lever 104 engaged pivotally to a pair of opposite posts 106 which lie along a pivoting axis disposed perpendicular to the mating axis 40. A pair of cam followers 108 project laterally outward from the female connector 36. The followers 108 interact with the cam lever 104 so that pivoting of the lever 104 causes the female connector 36 to move toward the male connector 38 along the mating axis 40. This cam lever feature is described in U.S. Pat. No. 5,810,612, issued Sep. 22, 1998 and is incorporated herein by reference.

Figure 10:
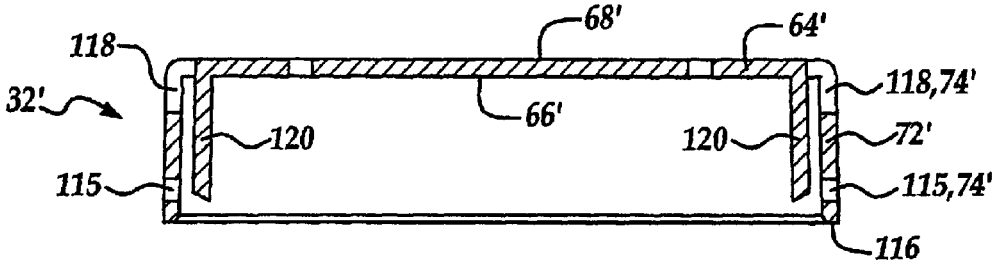
FIG. 10 is a cross section view of the blade stabilizer taken along line 10—10 of FIG. 9 viewing in the direction of the arrows.
Figure 11:
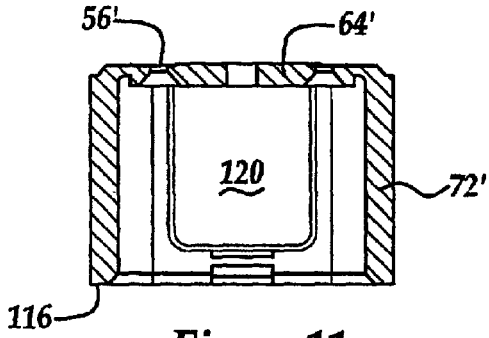
FIG. 11 is a cross section view of the blade stabilizer taken along line 11—11 of FIG. 9 viewing in the direction of the arrows.
Figure 12:
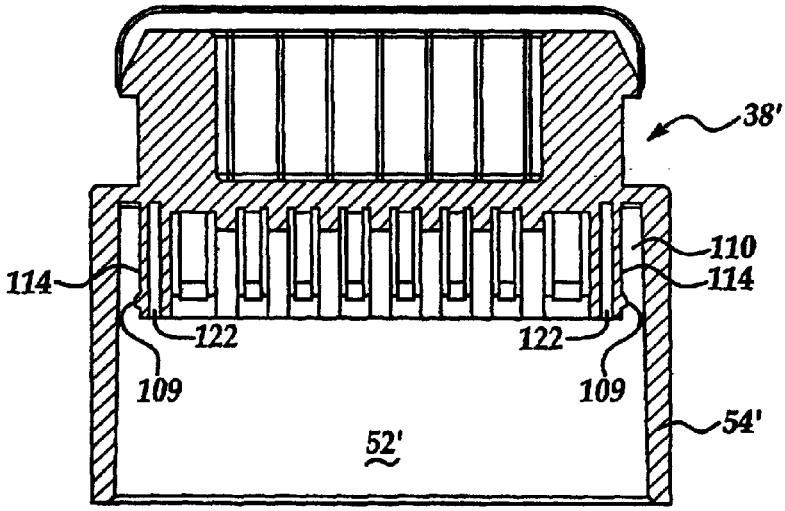
FIG. 12 is a cross section view of a male connector of the second embodiment taken along line 12—12 of FIG. 7 viewing in the direction of the arrows.
Figure 13:
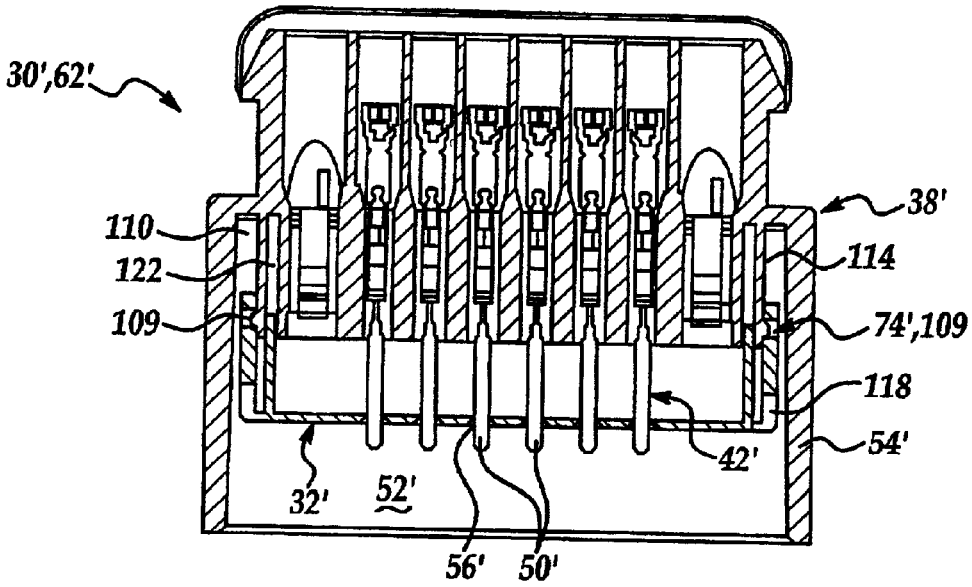
FIG. 13 is a cross section view of the electrical connector assembly of the second embodiment similar in perspective to FIG. 12 wherein the blade stabilizer is shown in a pre-staged position and a female connector is removed to show internal detail.
Figure 14:
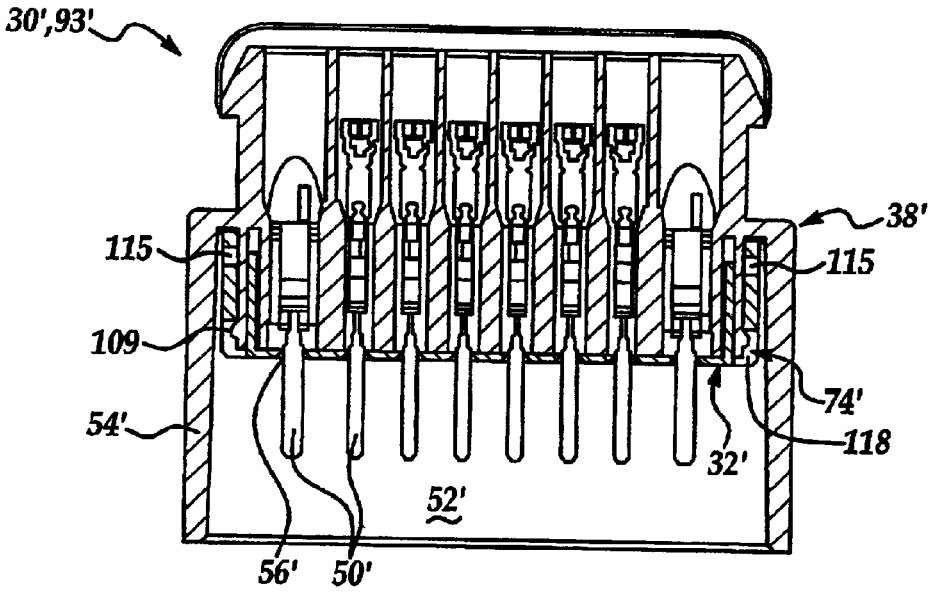
FIG. 14 is a cross section view of the electrical connector assembly similar in perspective to FIG. 13 except the blade stabilizer is shown in a staged position.

Referring to FIGS. 7–14, a second embodiment of the present invention is shown wherein a shroud 72' of a blade stabilizer 32' extends or projects rearward from a leading surface 66' of the stabilizer 32' and into an annular recess 110 carried by a male connector 38' of the electrical connector assembly 30', as best shown in FIG. 12. A locking tab 109 of a two-stage fastening feature 74' of the electrical connector assembly 30' which projects laterally into the annular recess 110 from a circumferential wall 112 carried by the male connector 38'. When the stabilizer 32' is in a pre-staged position 62' (as best shown in FIG. 13), the tab 109 snap fits into a pre-staged window 114 which communicates through either end of the shroud 72' of the stabilizer 32' near a leading peripheral edge 116. When the stabilizer 32' moves from the pre-staged position 62' to a staged position 93' as the electrical connector is simultaneously fully mated, the shroud 32' flexes radially outward to disengage the locking tab 109 from within the pre-staged window 114 and snap fits into a staged window 118 of the shroud 72' disposed near or at a plate 64' of the stabilizer 32', as best shown in FIG. 14.

Referring to FIGS. 10–12, the stabilizer 32' also has a pair of planar guide members 120 which insert into a pair of channels 122 carried by the male connector 38' and defined laterally inward from the circumferential wall 114. The guide members 120 align the stabilizer 32' to the male connector 38' and thus the apertures 56' to the blades 50'.

Figure 15:
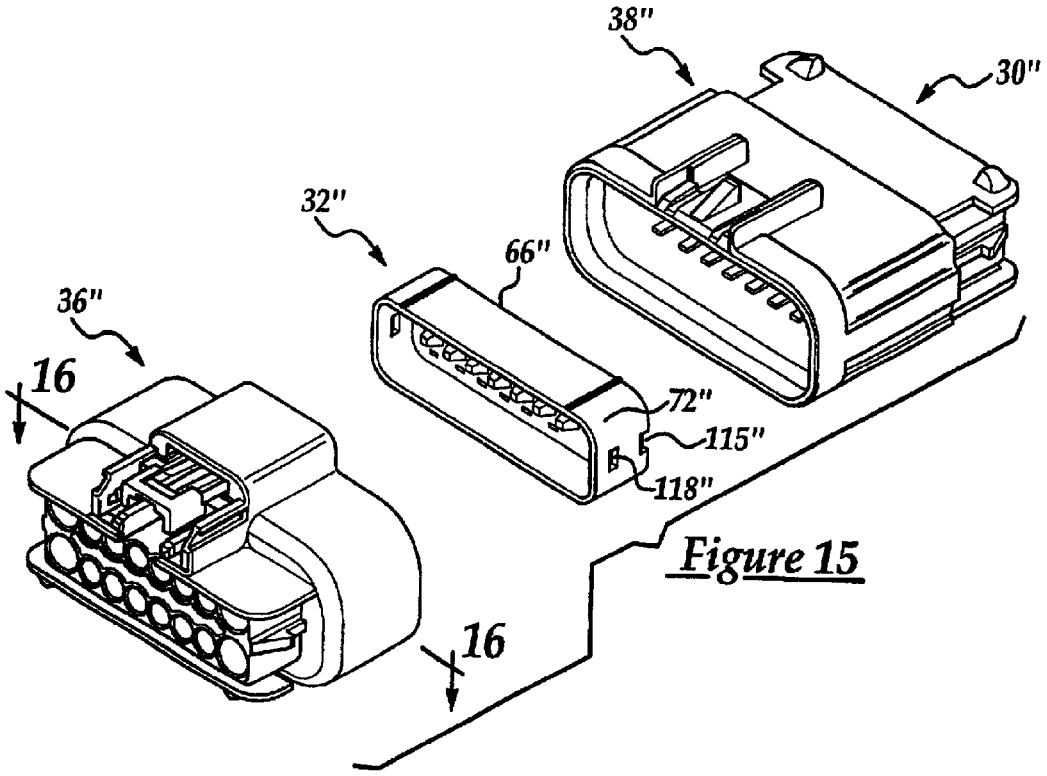
FIG. 15 is an exploded perspective view of a third embodiment of an electrical connector assembly of the present invention.
Figure 16:
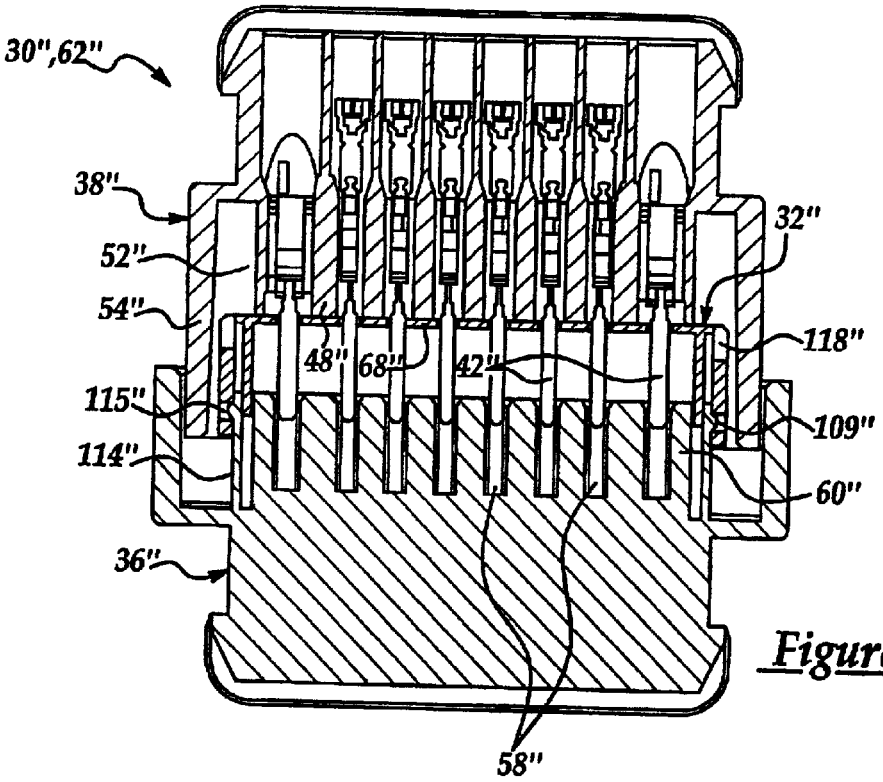
FIG. 16 is a cross section view of the electrical connector assembly of the third embodiment illustrating a blade stabilizer in a pre-staged position engaged to a female connector.
Figure 17:
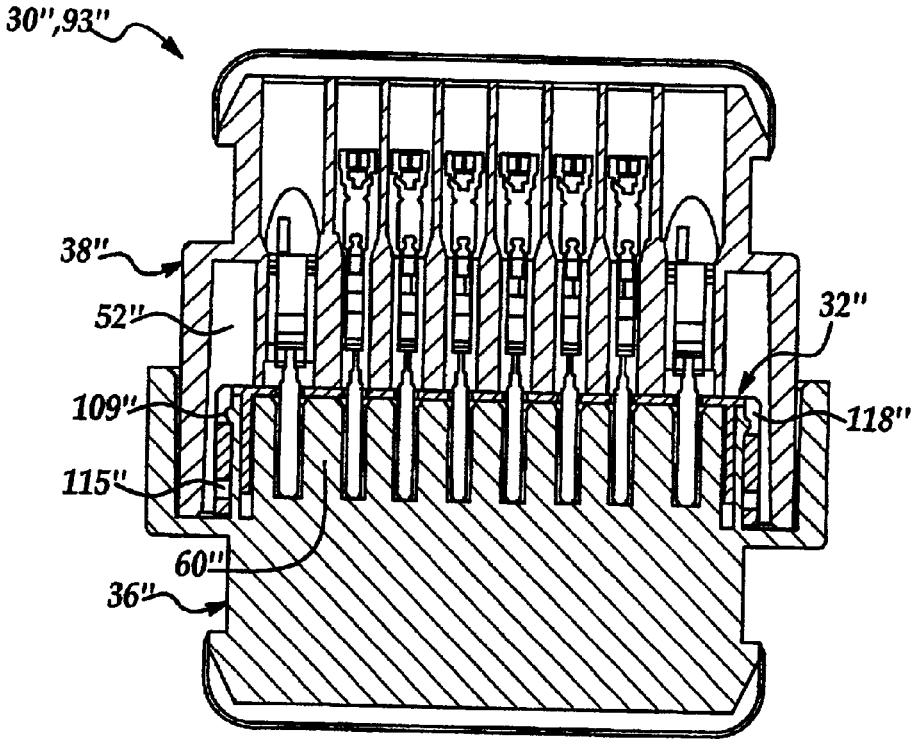
FIG. 17 is a cross section view of the electrical connector assembly similar in perspective to FIG. 16 except that the blade stabilizer is in a staged position and the electrical connector assembly is mated.

Referring to FIGS. 15 through 17, a third embodiment of the present invention is shown which is similar to the second embodiment except that a blade stabilizer 32" is engaged initially to a female connector 36" instead of a male connector 38" of an electrical connector assembly 30". The stabilizer 32" has a shroud 72" which projects forward from a trailing surface 68" of the stabilizer 32". Like the second embodiment, a pre-staged window 115" is located at both ends of the stabilizer 32" and is part of the indent detent interface 74". The pre-staged window 115" mates with a laterally outward projecting tab 109" of a female connector 36". The tabs 109" project laterally outward from a circumferential wall 114" of the female connector 36". When the stabilizer 32" is in a pre-staged position 62" (as best shown in FIG. 16) the trailing surface 68" is spaced axially from the end portion 60" of the female connector 36". During mating of electrical connector assembly 30", the pins or blades 50" of the terminals 42" insert through apertures of the stabilizer 32" and into receptacles 58" of the female connector 36". It is only after the leading surface 66" of the stabilizer 32" engages the forward face 48" of a male connector 38" that the stabilizer 32" begins to move from the pre-staged position 62" and into a staged position 93", as best shown in FIG. 17. Similar to the second embodiment, the tabs 109" move from the pre-staged widow 115" and into a staged window 118" both carried with the shroud 72" of the stabilizer 32".

Figure 18:
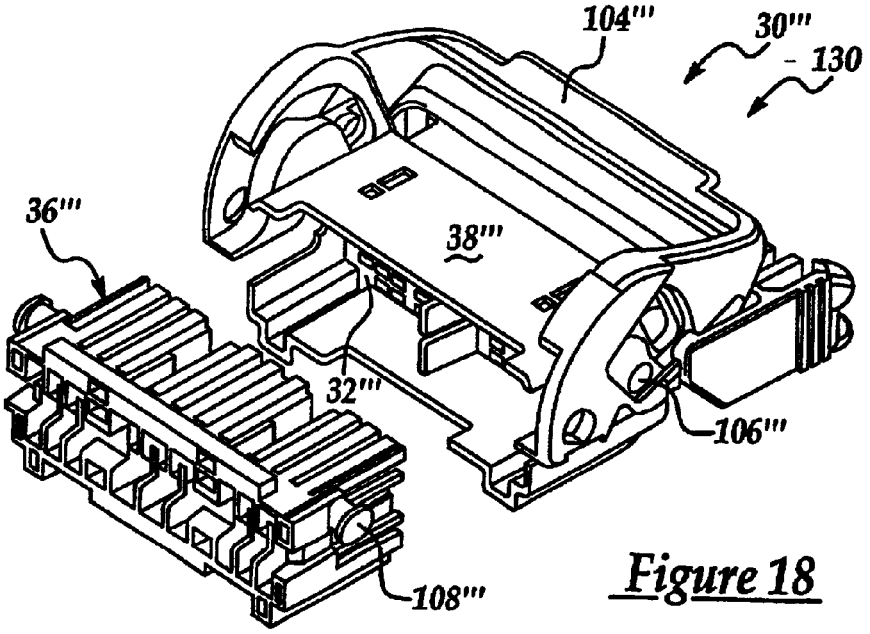
FIG. 18 is an exploded perspective view of a fourth embodiment of an electrical connector assembly.
Figure 19:
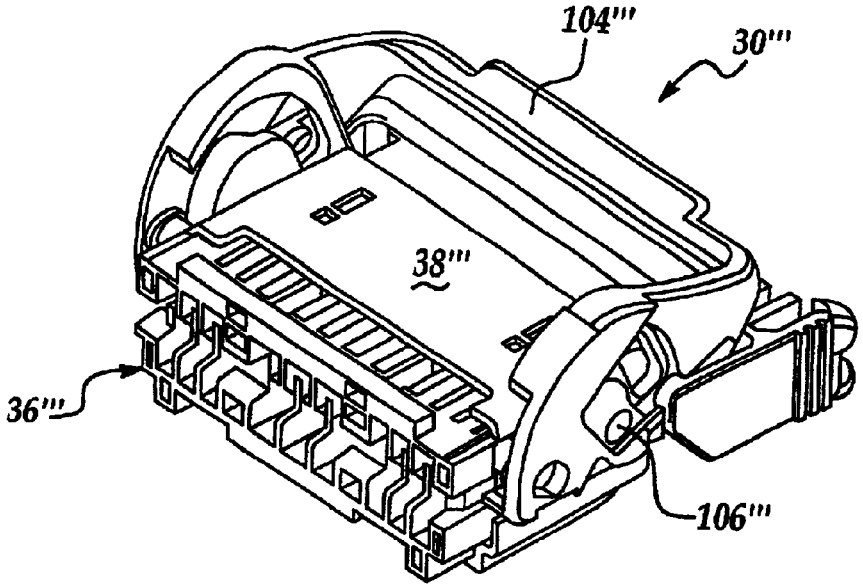
FIG. 19 is a perspective view of the electrical connector assembly illustrating a cam lever of a male connector shown in an unlocked position.
Figure 20:
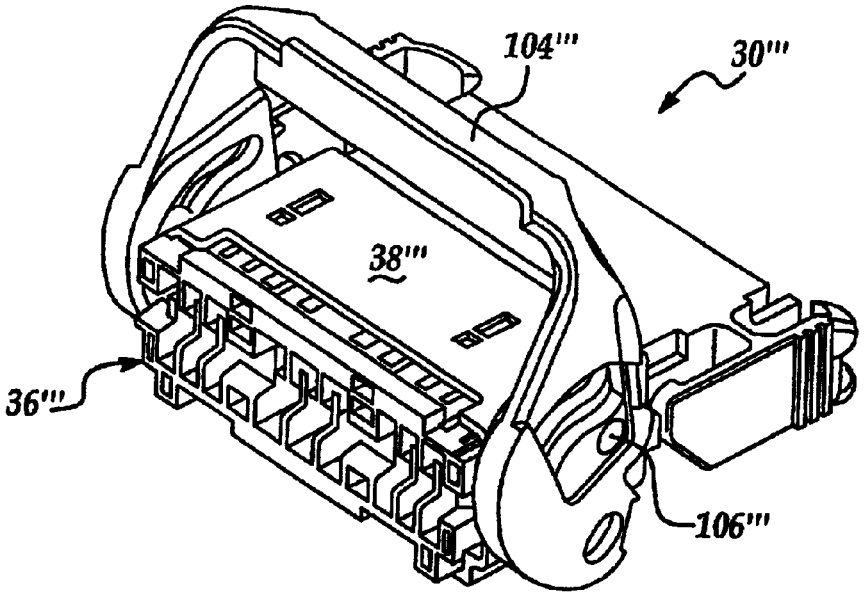
FIG. 20 is a perspective view of the electrical connector assembly showing the cam lever engaged to followers of a female connector in an intermediate position.
Figure 21:
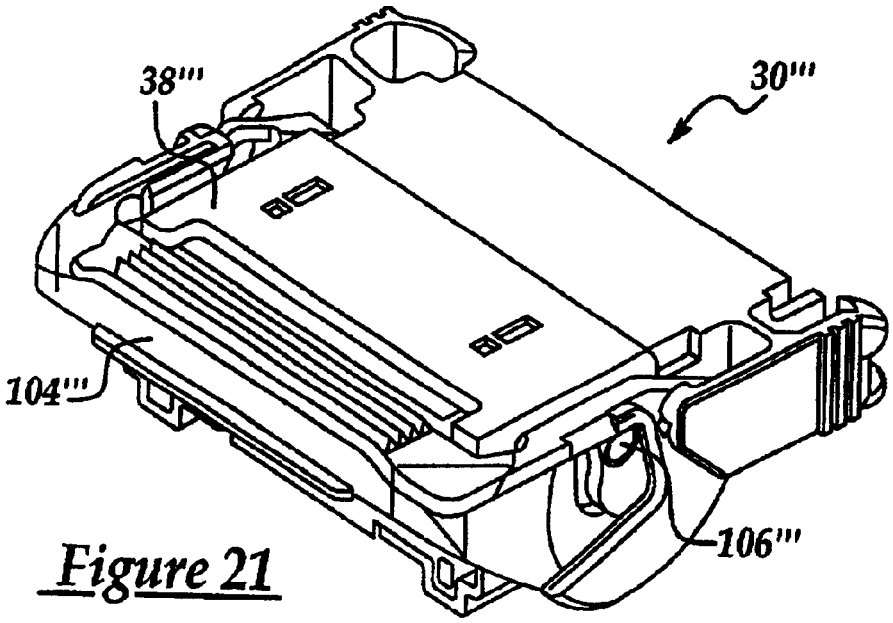
FIG. 21 is a perspective view of the electrical connector assembly in a mated position with the cam lever in a locked position.
Figure 22:
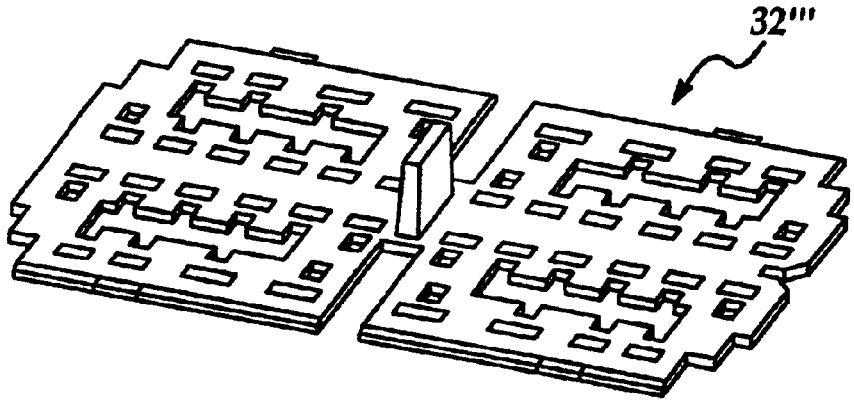
FIG. 22 is a perspective view of a blade stabilizer of the fourth embodiment.

Referring to FIGS. 18–23, a fourth embodiment of the present invention is shown wherein a blade stabilizer 32''', described in detail in parent application Ser. No. 09/795,692, filed Feb. 27, 2001, is utilized in unison with a cam lock arm assembly similar to that described in the first embodiment. FIG. 18 illustrates the electrical connector assembly 30''' in a non-mated position 130 with the blade stabilizer 32''' in a pre-staged position 62''' within a male connector 38'''. After the female connector 36''' is inserted into the male connector 38''' a cam lock lever 104''' of the cam lock assembly can be pivoted to engage two cam followers 108''' protruding from the female connectors 36''', as best shown in FIGS. 19–20. The cam lock lever 104''' as it continues to pivot will cause the female connector 36''' to engage the blade stabilizer 32''' as the electrical connector assembly 30''' is mated and the stabilizer 32''' moves to a staged position.

While the forms of the invention herein disclosed constitute presently preferred embodiments, many others are possible. It is not limited herein to mention all the possible equivalent forms or ramifications of the invention. It is understood that the terms used herein are merely descriptive rather than limiting and that various changes may be made without departing from the spirit or scope of the invention.

What is claimed is:

1. An electrical connector assembly comprising:

a male terminal having a pin projecting forward;

a housing having a male connector body having a forward face, a rearward face and a terminal cavity extending between and communicating through the forward and rearward faces, the male terminal being locked to the male connector body within the terminal cavity and the pin being projected through the forward face;

a stabilizer disposed within the housing, the stabilizer having a leading surface, a trailing surface and a pin aperture communicating through the leading and trailing surfaces;

a two-stage fastening feature formed between the stabilizer and the housing being constructed and arranged to snap fit the stabilizer to the housing in a pre-staged position and to snap fit the stabilizer to the housing in a staged position; and wherein the pin of the male terminal projects into the aperture when the stabilizer is in the pre-staged position.

2. The electrical connector assembly set forth in claim 1 comprising:

a mating axis;

a female connector body of the housing engaged to the male connector body along the mating axis, wherein the stabilizer is disposed axially between the male and female connector bodies;

a female terminal locked within the female connector body; and a pivoting cam lock lever assembly having a lock lever pivotally engaged to one connector body and a cam follower engaged to the other connector body, wherein the earn lock lever is engaged to the follower and rotary movement of the lever causes the connector bodies to move linearly along the mating axis to mate the connector bodies and insert the pin of the male terminal into the female terminal.

3. The electrical connector assembly set forth in claim 1 wherein the two-stage fastening feature is engaged between the stabilizer and the male connector body of the housing to snap fit the stabilizer to the male connector body in the pre-staged position.

4. The electrical connector assembly set forth in claim 3 comprising:

the stabilizer having a staged position;

a female terminal engaged electrically to the pin of the male terminal when the electrical connector assembly is mated;

a female connector body having a leading end, wherein the female terminals are locked within the leading end and aligned to the pin aperture of the stabilizer for receiving the pin of the male terminal when the electrical connector assembly is mated; and wherein the leading end engages the trailing surface of the stabilizer thereby moving the stabilizer from the pre-staged position to the staged position when the electrical connector assembly is being mated.

5. The electrical connector assembly set forth in claim 4 comprising:

a mating axis; and a shroud of the stabilizer projecting along the mating axis; and wherein the two-stage fastening feature is constructed and arranged between the shroud and the male connector body.

6. The electrical connector assembly set forth in claim 5 comprising:

a shroud of the male connector body projecting along the mating axis from the forward face;

wherein the shroud of the connector body is aligned axially and disposed laterally outward from the pin of the male terminal; and wherein the shroud of the stabilizer is disposed laterally inward from the shroud of the male connector body when the electrical connector assembly is mated.

7. An electrical connector assembly comprising:

a male terminal having a pin projecting forward;

a housing having a male connector body having a forward face, a rearward face and a terminal cavity extending between and communicating through the forward and rearward faces, the male terminal being locked to the male connector body within the terminal cavity and the pin being projected through the forward face;

a stabilizer disposed within the housing, the stabilizer having a leading surface, a trailing surface and a pin aperture communicating through the leading and trailing surfaces;

a two-stage fastening feature formed between the stabilizer and the housing being constructed and arranged to snap fit the stabilizer to the housing in a pre-staged position; and wherein the pin of the male terminal projects into the aperture when the stabilizer is in the pre-staged position;

wherein the two-stage fastening feature is engaged between the stabilizer and the male connector body of the housing to snap fit the stabilizer to the male connector body in the pre-staged position;

the stabilizer having a stated position;

a female terminal engaged electrically to the pin of the male terminal when the electrical connector assembly is mated;

a female connector body having a leading end, wherein the female terminals are locked within the leading end and aligned to the pin aperture of the stabilizer for receiving the pin of the male terminal when the electrical connector assembly is mated; and wherein the leading end engages the trailing surface of the stabilizer thereby moving the stabilizer from the pre-staged position to the staged position when the electrical connector assembly is being mated;

a shroud of the male connector body projecting along the mating axis from the forward face;

wherein the shroud of the connector body is aligned axially and disposed laterally outward from the pin of the male terminal;

wherein the shroud of the stabilizer is disposed laterally inward from the shroud of the male connector body when the electrical connector assembly is mated;

the two-stage fastening feature having a protuberance projecting laterally outward from the shroud of the stabilizer, a forward locking nub and a rearward locking nub projecting laterally inward from the shroud of the male connector body;

wherein the protuberance is snap fitted axially between the forward and rearward locking nubs when the stabilizer is in the pre-staged position; and wherein the protuberance snap fits over the rearward locking nub when the stabilizer moves from the pre-staged position into the staged position as the electrical connector assembly is being mated.

8. The electrical connector assembly set forth in claim 7 wherein the trailing and leading surfaces of the stabilizer are carried by a plate of the stabilizer disposed perpendicular to the mating axis which is bisected into a first segment and a second segment by a slot, and wherein the first and second segments are interconnected by a web member which performs as a spring for flexing of the shroud of the stabilizer when the protuberance snaps over the forward and rearward locking nubs of the shroud of the male connector body.

9. The electrical connector assembly set forth in claim 8 comprising:

the stabilizer having an indexing window carried by the stabilizer shroud and extending forward from the plate; and the male connector body having an indexing tab which conforms in shape to the indexing window and projects laterally inward from the shroud of the male connector body, wherein the indexing tab is disposed in the indexing window when the stabilizer is in the staged position.

10. The electrical connector assembly set forth in claim 9 comprising a pivoting lock lever assembly pivotally engaged to one connector body and a cam follower engaged to the other connector body, wherein the cam lock lever engages the follower to mate the connector bodies and insert the pins into the female terminal as the lever is pivoted.

11. The electrical connector assembly set forth in claim 6 wherein the shroud of the stabilizer projects axially rearward from the leading surface of the stabilizer.

12. The electrical connector set forth in claim 11 wherein the shroud of the stabilizer projects into an annular recess carried by the male connector body and disposed rearward of the forward face.

13. The electrical connector assembly set forth in claim 10 comprising:

the two-stage fastening feature having a pre-staged window and a staged window carried by the shroud of the stabilizer, wherein the pre-staged window is disposed axially rearward of the staged window;

a locking tab projecting laterally from the male connector body;

wherein the locking tab projects into the pre-staged window when the stabilizer is in the pre-staged position; and wherein the locking tab projects into the staged window when the stabilizer is in the staged position.

14. The electrical connector assembly set forth in claim 13 wherein the locking tab projects radially outward from a circumferential wall of the male connector body and into the annular recess.

15. The electrical connector assembly set forth in claim 14 wherein the shroud of the stabilizer is disposed laterally between and aligned axially with the shroud of the male connector portion and the circumferential wall.

16. The electrical connector assembly set forth in claim 15 comprising:

the stabilizer having a stiffener member projecting rearward from the leading surface of the stabilizer and disposed laterally inward from the shroud of the stabilizer; and a channel carried by the male connector body and defined laterally inward from the circumferential wall, wherein the stiffener member extends into the channel when the stabilizer is in the pre-staged and staged positions.

17. The electrical connector assembly set forth in claim 1 wherein the two-stage fastening feature is constructed and arranged to engage between the stabilizer and a female connector body of the housing to snap fit the stabilizer to the female connector body in the pre-staged position.

18. The electrical connector assembly set forth in claim 17 comprising:

a mating axis;

the stabilizer having a staged position;

a female receptacle; and the female connector body having a leading end which locks to the female terminal which aligns to the aperture of the stabilizer and receives the pin of the terminal when the electrical connector is mated, wherein the leading end is spaced axially from the trailing surface of the stabilizer when the stabilizer is in the pre-staged position.

19. The electrical connector assembly set forth in claim 18 comprising:

a plate of the stabilizer carrying the leading and trailing surfaces and disposed perpendicular to the mating axis and a shroud projecting axially from the trailing surface of the plate; and wherein the two-stage fastening feature is constructed and arranged between the shroud of the stabilizer and the female connector body.

20. The electrical connector assembly set forth in claim 19 comprising:

the leading end of the female connector body having a circumferential wall facing radially outward with respect to the mating axis;

a locking tab of the two-stage fastening feature projecting laterally outward from the circumferential wall of the leading end;

a pre-staged window and a staged window carried by the shroud of the stabilizer, wherein the pre-staged window is disposed axially forward of the staged window;

wherein the locking tab projects into the staged window when the stabilizer is in the pre-staged position; and wherein the locking tab projects into the staged window when the stabilizer is in the staged position.

21. An electrical connector assembly comprising:

a mating axis;

a male connector having a forward face and an elongated male terminal disposed longitudinally along the mating axis, the male terminal having a pin projecting axially forward from the forward face;

a female connector having a female receptacle for axial receipt of the pin of the male terminal when the electrical connector assembly is mated along the mating axis;

a pin stabilizer disposed axially between the male and female connectors, the pin stabilizer having a leading surface, a trailing surface and a pin aperture extending axially and communicating through the leading and trailing surfaces;

a two-stage fastening feature formed between the pin stabilizer and the male connector, the two-stage fastening feature being constructed and arranged to snap fit the pin stabilizer to the housing in a pre-staged position prior to mating and snap fit the pin stabilizer to a staged position simultaneously to mating of the electrical connector assembly;

wherein a distal end of the pin of the male terminal projects axially forward into the aperture when the stabilizer is in the pre-staged position and the blade substantially extends axially forward through the aperture when the electrical connector assembly is mated and the stabilizer is in the staged position; and a pivoting cam lock lever assembly having a lock lever pivotally engaged to one connector and a cam follower engaged to the other connector, wherein the cam lock lever is engaged to the follower and rotary movement of the lever causes the connectors to move linearly along the mating axis to mate the connectors and insert the pin of the male terminal into the female terminal.

22. The electrical connector assembly set forth in claim 21 comprising:

the pin stabilizer having a plate disposed perpendicular to the mating axis and a shroud projecting axially with respect to the mating axis and perpendicularly from the plate, and wherein the plate carries and is defined between the forward and rearward surfaces; and the male connector having a forward projecting shroud radially defining a chamber, wherein the pins of the male terminals are disposed within the chamber; and wherein the stabilizer is disposed within the chamber when the electrical connector assembly is mated.

23. The electrical connector assembly set forth in claim 22 wherein the shroud projects axially with respect to the mating axis and forward from the forward surface of the plate.

24. The electrical connector assembly set forth in claim 23 comprising:

the two-stage fastening feature having a protuberance projecting laterally outward from the shroud of the stabilizer, and forward and rearward locking nubs projecting laterally inward from the shroud of the male connector shroud;

wherein the protuberance is snap fitted axially between the forward and rearward locking nubs when the stabilizer is in the pre-staged position; and wherein the protuberance is snap fitted rearward of the rearward locking nub when the stabilizer is in the staged position.

25. The electrical connector assembly set forth in claim 22 wherein the shroud projects axially with respect to the mating axis and rearward from the rearward surface of the plate.

26. The electrical connector assembly set forth in claim 25 comprising:

the two-stage fastening feature having a pre-staged window and a staged window communicating through the shroud of the stabilizer, wherein the pre-staged window is disposed axially rearward of the staged window;

a locking tab projecting laterally outward from the male connector body;

wherein the locking tab projects into the pre-staged window when the stabilizer is in the pre-staged position; and wherein the locking tab projects into the staged window when the stabilizer is in the staged position.

27. An electrical connector assembly comprising:

a male terminal having a pin projecting forward;

a housing having a male connector body having a forward face, a rearward face and a terminal cavity extending between and communicating through the forward and rearward faces, the male terminal being locked to the male connector body within the terminal cavity and the pin being projected through the forward face;

a stabilizer disposed within the housing, the stabilizer having a leading surface, a trailing surface and a pin aperture communicating through the leading and trailing surfaces;

a two-stage fastening feature formed between the stabilizer and the housing being constructed and arranged to snap fit the stabilizer to the housing in a pre-staged position and in a staged position;

the pin of the male terminal projecting through the pin aperture when the stabilizer is in the pre-staged position;

the two-stage fastening feature being engaged between the stabilizer and the male connector body of the housing to snap fit the stabilizer to the male connector body in the pre-staged position and in the staged position;

the two-stage fastening feature comprising a protuberance projecting laterally outward from a shroud of the stabilizer and, a forward locking nub and a rearward locking nub projecting laterally inward from a shroud of the male connector body;

the protuberance being snap fitted axially between the forward and rearward locking nubs when the stabilizer is in the pre-staged position; and the protuberance snap being snap fitted over the rearward locking nub when the stabilizer is in the staged position.

28. The electrical connector assembly set forth in claim 27 wherein the trailing and leading surfaces of the stabilizer are carried by a plate of the stabilizer disposed perpendicular to the shroud of the stabilizer, the plates being separated into a first segment and a second segment by a slot, and wherein the first and second segments are interconnected by a web member which performs as a spring for flexing of the shroud of the stabilizer when the protuberance snaps over the forward and rearward locking nubs of the shroud of the male connector body.

29. The electrical connector assembly set forth in claim 28 comprising:

the stabilizer having an indexing window carried by the shroud of the stabilizer and extending forward from the plate; and the male connector body having an indexing tab which conforms in shape to the indexing window and projects laterally inward from the shroud of the male connector body, wherein the indexing tab is disposed in the indexing window when the stabilizer is in the staged position.

30. The electrical connector assembly set forth in claim 29 comprising a pivoting lock lever assembly pivotally engaged to one connector body and a cam follower engaged to the other connector body, wherein the cam lock lever engages the follower to mate the connector bodies and insert the pins into the female terminal as the lever is pivoted.

* * * * *